US008664890B2

(12) United States Patent
Hsieh et al.

(10) Patent No.: US 8,664,890 B2
(45) Date of Patent: Mar. 4, 2014

(54) LED DISPLAY DEVICE PROVIDING CURRENT CORRECTION AND CORRECTION METHOD THEREOF

(75) Inventors: Kuan-Hong Hsieh, Taipei Hsien (TW); Han-Che Wang, Taipei Hsien (TW); Hua-Dong Cheng, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 390 days.

(21) Appl. No.: 12/953,476

(22) Filed: Nov. 24, 2010

(65) Prior Publication Data

US 2011/0309765 A1 Dec. 22, 2011

(30) Foreign Application Priority Data

Jun. 22, 2010 (CN) ..... 2010 1 0206038

(51) Int. Cl.
*H05B 37/02* (2006.01)

(52) U.S. Cl.
USPC ..... 315/294; 315/299; 315/308

(58) Field of Classification Search
USPC ..... 315/291, 209 R, 210, 217, 246, 299, 315/307, 308, 294
See application file for complete search history.

(56) References Cited

U.S. PATENT DOCUMENTS

| | | | | |
|---|---|---|---|---|
| 7,560,981 | B2 * | 7/2009 | Chao et al. | 327/540 |
| 8,044,608 | B2 * | 10/2011 | Kuo et al. | 315/291 |
| 8,330,393 | B2 * | 12/2012 | Thomson et al. | 315/308 |
| 8,334,662 | B2 * | 12/2012 | Jin et al. | 315/299 |
| 2010/0109537 | A1 * | 5/2010 | Nishino et al. | 315/185 R |
| 2010/0164403 | A1 * | 7/2010 | Liu | 315/297 |

FOREIGN PATENT DOCUMENTS

| | | | |
|---|---|---|---|
| CN | 101222805 | A | 7/2008 |
| TW | 200950589 | A | 12/2009 |
| TW | 201010504 | A1 | 3/2010 |

* cited by examiner

*Primary Examiner* — Thuy Vinh Tran

(74) *Attorney, Agent, or Firm* — Altis Law Group, Inc.

(57) ABSTRACT

An LED display device providing current correction includes a number of LED modules, a microprocessor, and a storage unit storing a standard voltage value. The correction sequence begins with each of the plurality of LED modules entering a work state in sequence, outputting a feedback voltage indicating work current of one of the LED modules to the microprocessor in sequence, comparing the feedback voltage with the standard voltage, adjusting the current of the LED module if the feedback voltage does not equal the standard voltage.

15 Claims, 2 Drawing Sheets

LED DISPLAY DEVICE PROVIDING CURRENT CORRECTION AND CORRECTION METHOD THEREOF

BACKGROUND

1. Technical Field

The present disclosure relates to LED display devices and, particularly, to an LED display device providing current correction and correction method thereof.

2. Description of Related Art

Conventional LED display devices include many LEDs, and each LED was produced exactly the same during manufacture, as a result, currents through the LEDs differ even when the LEDs are driven by the same voltage.

Therefore, it is desirable to provide an LED display device to overcome the described limitations.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail, with reference to the accompanying drawings.

Figure 1:
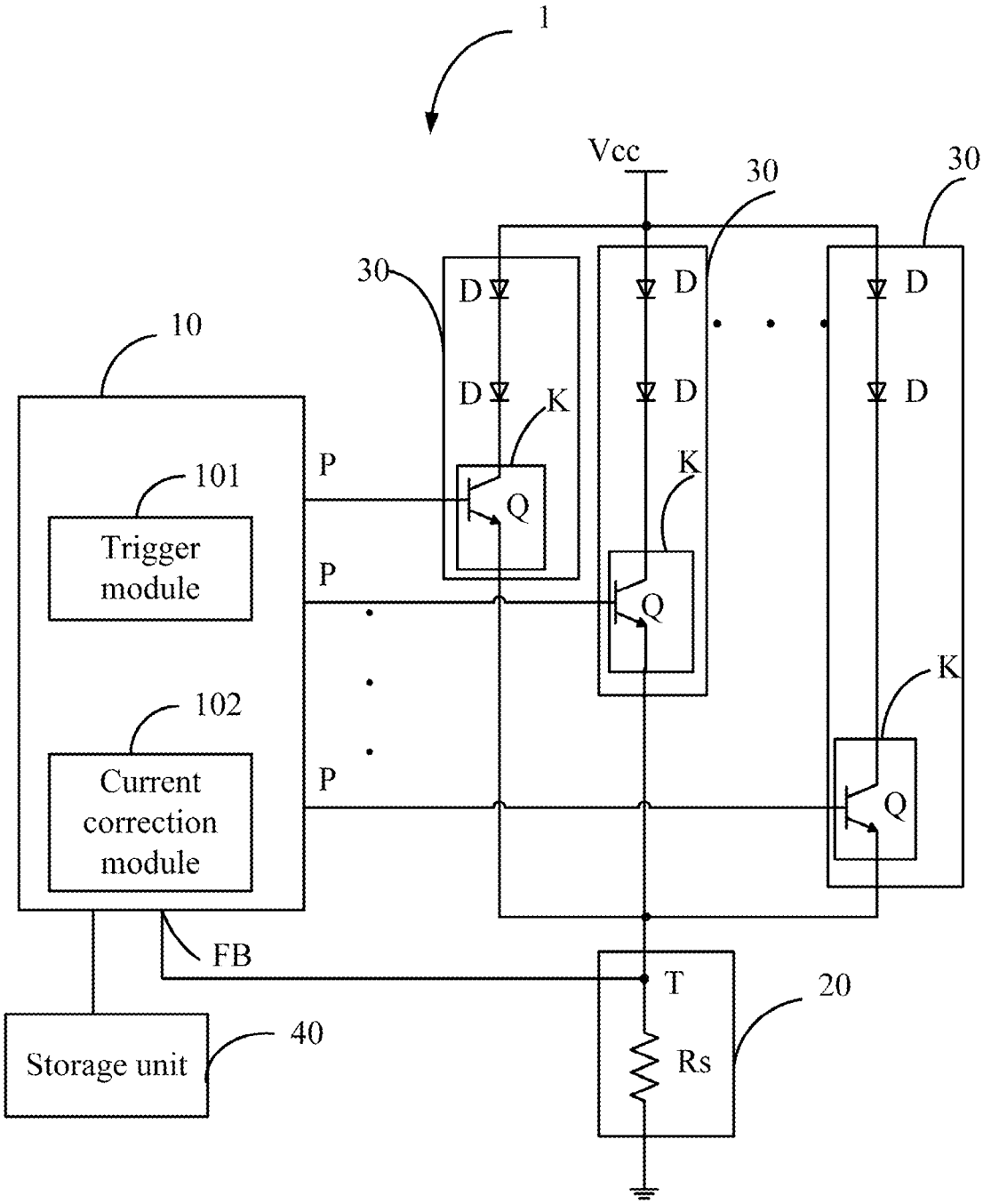
FIG. 1 is a circuit diagram of an LED display device capable of correcting its current, in accordance with an exemplary embodiment.

Referring to FIG. 1, an LED display device 1 capable of correcting its current is provided in accordance with an exemplary embodiment. The LED display device 1 includes a microprocessor 10, a feedback voltage generating module 20, and a number of LED modules 30. The microprocessor 10 includes a number of output ports P and a feedback port FB. Each output port P is connected to one LED module 30, and is used to output a pulse width modulation (PWM) signal to turn the LED module 30 on, when the LED display device enters a correction mode.

In the embodiment, the LED modules 30 are connected in parallel between a high potential point Vcc and the feedback voltage generating module 20. Each LED module 30 includes a control switch K and at least one LED D, and is connected between the high potential point Vcc and the feedback voltage generating module 20 in serial. Each output port P of the microprocessor 10 is connected to one control switch K of one LED module 30, and outputs the PWM signal to turn on the corresponding control switch K and thus turn on the corresponding LED module 30 when the LED display device 1 enters the correction mode. When the control switch K is turned on, current is generated through the at least one LED D connected to the control switch K which is turned on, and the LED module 30 is turned on and is in a work state, namely, the LED module 30 emits light. The feedback voltage generating module 20 further connects to the feedback port FB, and is used to produce a feedback voltage reflecting the current through the LED module 30 which is turned on. The feedback voltage generating module 20 outputs the feedback voltage to the feedback port FB of the microprocessor 10.

The LED display device 1 further includes a storage unit 40. The storage unit 40 stores a standard voltage value which reflects a standard current through the LED modules 30. The microprocessor 10 includes a trigger module 101 and a current correction module 102. The trigger module 101 produces a trigger signal to trigger the LED display device 1 to enter the correction mode. This can take place periodically, namely the trigger module 101 produces the trigger signal at intervals. The interval can be set by the user or be a system default setting. In other embodiments, the trigger module 101 produces the trigger signal when the LED display device 1 starts to turn on or turn off. In another embodiment, the LED display device 1 further includes a particular key (not shown) for directing the trigger module 101 to produce the trigger signal.

The current correction module 102 receives the trigger signal and turns the LED module 30 on in sequence. In detail, the current correction module 102 directs one of the output ports P to output a PWM signal to turn on corresponding control switch K in sequence, and the LED modules 30 are turned on in sequence. When one of the LED modules 30 is turned on, the feedback voltage generating module 20 produces a feedback voltage reflecting the current through the LED module 30, and outputs the feedback voltage to the feedback port FB of the microprocessor 10.

The current correction module 102 receives the feedback voltage via the feedback port FB and compares the feedback voltage with the standard voltage stored in the storage unit 40, and corrects the PWM signal output by the corresponding output port P according to the comparison result, thereby correcting the value of the current through the LED module 30 which is turned on. In detail, if the feedback voltage is lower than the standard voltage, the current correction module 102 adjusts the PWM signal of the output port P connected to the LED module 30 which is turned on to increase the current through the LED module 30. If the feedback voltage exceeds the standard voltage, and the current correction module 102 adjusts the PWM signal to reduce the current through the LED module 30. In the embodiment, the current correction module 102 increases or reduces the current through the LED module 30 by adjusting the duty cycle of the PWM signal. When the duty cycle of the PWM signal is increased, the current through the LED module 30 is increased, and when the duty cycle of the PWM signal is decreased, the current through the LED module 30 is decreased commensurately.

In the embodiment, each control switch K includes a control terminal (not labeled), a first path terminal (not labeled), and a second path terminal (not labeled). The control terminals of the control switches K are respectively connected to the output ports P, and the first path terminal of each control switches is connected to the LED D of the corresponding LED module 30. The feedback voltage generating module 20 includes a resistor Rs connected between all of the second path terminals and the ground. A terminal T of the resistor Rs is connected to the feedback port FB of the microprocessor 10. In the embodiment, the control switches K are negative-positive-negative (NPN) bipolar junction transistors (BJTs) Q. A base, an emitter, and a collector of the NPN BJTs Q function as the control terminal, the first path terminal, the second path terminal of the control switches K.

As described, when the current correction module 102 receives the trigger signal from the trigger module 101, the current correction module 102 controls the output ports P to respectively output the PWM signal to turn on the control switches K in sequence. When one of the control switches K is turned on, the high potential point Vcc, the corresponding LED module 30, the resistor Rs, and the ground form a loop, then there is current flows through the LED module 30, and the resistor Rs. Therefore, the terminal T of the resistor Rs has a voltage, and the voltage is the feedback voltage reflecting the current through the LED module 30 that is turned on currently. As described, the current correction module 102 receives the feedback voltage via the feedback port FB of the microprocessor 10, and compares the feedback voltage with the standard voltage and adjusts the PWM signal output by the output port P connected to the LED module 30 which is turned on when the feedback voltage does not equal the standard voltage.

Thus, in the embodiment, the LED display device 1 can correct the current through LED modules 30 individually when the LED display device 1 enters the correction mode.

Figure 2:
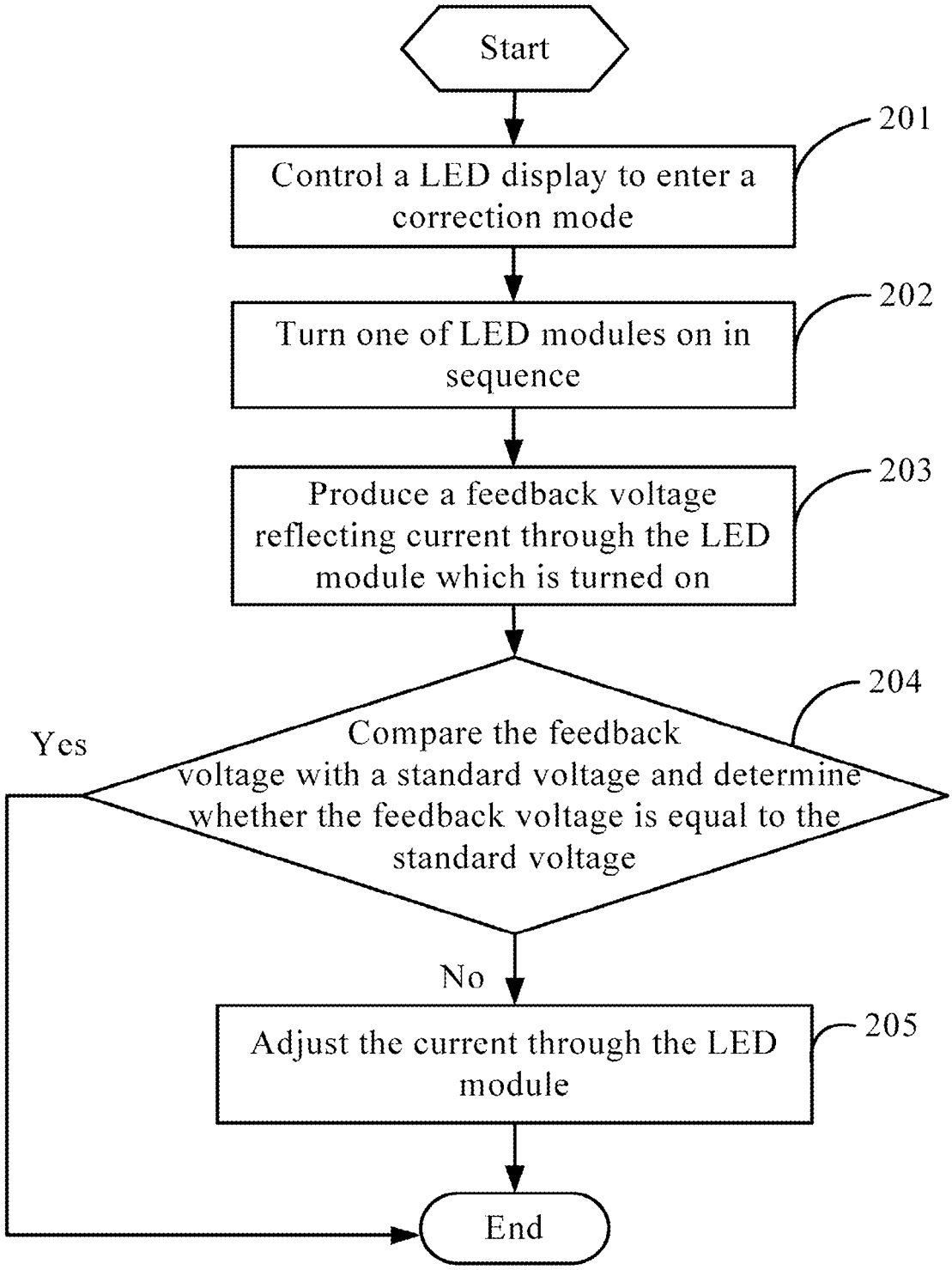
FIG. 2 is a flowchart illustrating a method for correcting current of each LED module of a LED display device, such as, for example, that of FIG. 1, in accordance with an exemplary embodiment.

FIG. 2 is a flowchart illustrating a method for correcting current of each LED module of a LED display device such as, for example, that of FIG. 1. In step S201, the trigger module 101 produces a trigger signal to trigger the LED display device 1 to enter a correction mode periodically or when the key is operated.

In step S202, the current correction module 102 turns on the LED modules 30 in sequence when receiving the trigger signal, namely, the current correction module 102 controls the output ports P to output the PWM signal to turn the control switch K of each LED modules 30 on in sequence.

In step S204, the current correction module 102 compares the feedback voltage with a standard voltage stored in the storage unit 40.

In step S205, the current correction module 102 adjusts the PWM signal output by the output port P connected to the LED module 30 which is turned on when the feedback voltage does not equal the standard voltage. Namely, when the feedback voltage is lower than the standard voltage, the current correction module 102 increases the duty cycle of the PWM signal, and when the feedback voltage exceeds the standard voltage, the current correction module 102 decreases the duty cycle of the PWM signal.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An LED display device for providing current correction, comprising:

a storage unit storing a standard voltage;

a microprocessor comprising:

a trigger module to produce a trigger signal;

a current correction module;

a plurality of output ports; and a feedback port;

a feedback voltage generating module, wherein, the feedback voltage generating module comprises a resistor, the resistor is connected between the feedback port and ground; and a plurality of LED modules connected in parallel between a high potential point and the resistor, each LED module being connected to one output port;

wherein, upon a condition that the trigger module produces a trigger signal, the current correction module controls each of the plurality of output ports to output a pulse width modulation (PWM) signal to turn on one of the plurality of LED modules connected to the output port in sequence; the feedback voltage generating module produces a feedback voltage reflecting current through one of the LED modules which is turned on in sequence; the current correction module receives the feedback voltage via the feedback port and compares the feedback voltage with the standard voltage stored in the storage unit, and adjusts the PWM signal output by the output port connected to the LED module which is turned on if the feedback voltage does not equal the standard voltage.

2. The LED display device according to claim 1, wherein each LED module comprises a control switch and at least one LED, wherein the control switch and the at least one LED are connected between the high potential point and the feedback voltage generating module in series, and wherein each output port of the microprocessor is connected to the control switch of each LED module.

3. The LED display device according to claim 2, wherein each control switch comprises a control terminal, a first path terminal, and a second path terminal, and wherein the control terminal of each control switch is connected to one of the plurality of output ports, the first path terminal of each control switch is connected to the at least one LED of the LED module comprising the control switch, and the second path terminal of each switch is connected to a terminal of the resistor connected to the feedback port.

4. The LED display device according to claim 3, wherein the control switches are negative-positive-negative (NPN) bipolar junction transistors (BJTs), a base, an emitter, and a collector of each NPN BJT are the control terminal, the first path terminal, the second path terminal, respectively.

5. The LED display device according to claim 3, wherein when one of the at least one LED module is turned on, the terminal of the resistor connected to the feedback port produces the feedback voltage.

6. The LED display device according to claim 1, wherein when the current correction module determines that the feedback voltage is lower than the standard voltage, the current correction module increases the duty cycle of the PWM signal output by the output port connected to the LED module which is turned on, and wherein when the current correction module determines the feedback voltage exceeds the standard voltage, the current correction module decreases the duty cycle of the PWM signal output by the output port connected to the LED module which is turned on.

7. The LED display device according to claim 1, wherein the trigger module produces the trigger signal at intervals, and the interval is set by the user or is a system default setting.

8. The LED display device according to claim 1, wherein the trigger module produces the trigger signal when the LED display device starts to turn on or turn off.

9. The LED display device according to claim 1, further comprising means for directing the trigger module to produce the trigger signal when the means is operated.

10. A method for correcting current of a LED display device, the LED display device comprises a plurality of LED modules, and a storage unit, the storage unit stores a standard voltage, the method comprising:

controlling the LED display device to enter a correction mode;

turning on one of the plurality of LED modules in sequence upon a condition that a trigger signal is produced;

producing a feedback voltage reflecting current through one of the LED modules which is turned on in sequence via a resistor connected between the LED modules and ground;

comparing the feedback voltage with the standard voltage; and adjusting the current of the LED module which is turned on when the feedback voltage does not equal the standard voltage.

11. The method according to claim 10, wherein the step of turning on one of the plurality of LED modules in sequence comprising:

outputting a PWM signal to turn on one of the plurality of LED modules in sequence.

12. The method according to claim 11, wherein the step of adjusting the current of the LED module which is turned on when the feedback voltage does not equal the standard voltage comprising:

adjusting the duty cycle of the PWM signal to adjust the current of the LED module which is turned on when the feedback voltage does not equal the standard voltage.

13. The method according to claim 10, wherein the step of controlling the LED display device to enter the correction mode comprising:

controlling the LED display device to enter the correction mode at a time interval, and the time interval is set by the user or is a system default setting.

14. The method according to claim 10, wherein the step of controlling the LED display device to enter the correction mode comprising:

controlling the LED display device to enter the correction mode when the LED display device starts to turn on or turn off

15. The method according to claim 10, wherein the LED display device further comprises a particular key, wherein the step of controlling the LED display device to enter the correction mode comprising:

controlling the LED display device to enter the correction mode when the particular key is operated.

* * * * *